US006416163B1

(12) United States Patent
ElHatem et al.

(10) Patent No.: US 6,416,163 B1
(45) Date of Patent: Jul. 9, 2002

(54) PRINTHEAD ARRAY COMPENSATION DEVICE DESIGNS

(75) Inventors: Abdul M. ElHatem, Redondo Beach; Lamar T. Baker, Manhattan Beach; Jaime Lerma, Murrieta; Mostafa R. Yazdy, Los Angeles, all of CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/447,316

(22) Filed: Nov. 22, 1999

(51) Int. Cl.[7] ..... B41J 2/135
(52) U.S. Cl. ..... 347/46
(58) Field of Search ..... 347/10, 11, 19, 347/68–71

(56) References Cited

U.S. PATENT DOCUMENTS

| | | | |
|---|---|---|---|
| 4,745,419 | A | 5/1988 | Quate et al. |
| 4,751,530 | A | 6/1988 | Elrod et al. |
| 4,782,350 | A | 11/1988 | Smith et al. |
| 4,801,953 | A | 1/1989 | Quate |
| 4,959,674 | A | 9/1990 | Khri-Yakub et al. |
| 5,087,931 | A | 2/1992 | Rawson |
| 5,121,141 | A | 6/1992 | Hadimioglu et al. |
| 5,122,818 | A | 6/1992 | Elrod et al |
| 5,142,307 | A | 8/1992 | Elrod et al. |
| 5,216,451 | A | 6/1993 | Rawson et al. |
| 5,339,101 | A | 8/1994 | Rawson et al. |
| 5,389,956 | A | 2/1995 | Hadimioglu et al. |
| 5,450,107 | A | 9/1995 | Rawson |
| 5,589,864 | A | 12/1996 | Hadimioglu |
| 5,808,636 | A | 9/1998 | Stearns |

FOREIGN PATENT DOCUMENTS

| | | | |
|---|---|---|---|
| EP | 0 704 304 | A | 4/1996 |
| EP | 0 953 451 | A | 11/1999 |
| JP | 411058781 | * | 3/1999 |

* cited by examiner

*Primary Examiner*—John Barlow
*Assistant Examiner*—Michael S. Brooke
(74) *Attorney, Agent, or Firm*—Fay, Sharpe, Fagan, Minnich & McKee, LLP

(57) ABSTRACT

Described are various compensation circuit designs to ensure proper shutoff of an unselected transducer in a transducer switching matrix. The switch of an unselected transducer is moved to a strong OFF state by injection of a compensation current. The compensation network is implemented as semiconductor integrated circuits which provide a high-voltage column switching diode, and a compensation switch. The compensation switch and column switching diode are configured such that they are isolated from each other.

20 Claims, 13 Drawing Sheets

PRINTHEAD ARRAY COMPENSATION DEVICE DESIGNS

BACKGROUND OF THE INVENTION

The present invention relates to acoustic printing, and more particularly to improving the off state of a column switch, in order to control the on/off switching ratio between ejectors of an acoustic printhead.

The fundamentals of acoustically ejecting droplets from an ejector device such as a printhead has been widely described, and the present assignee has obtained patents on numerous concepts related to this subject matter. In acoustic printing, an array of ejectors forming a printhead is covered by a pool of liquid. Each ejector can direct a beam of sound energy against a free surface of the liquid. The impinging acoustic beam exerts radiation pressure against the surface of the liquid. When the radiation pressure is sufficiently high, individual droplets of liquid are ejected from the pool surface to impact upon a medium, such as paper, to complete the printing process. The ejectors may be arranged in a matrix or array of rows and columns, where the rows stretch across the width of the recording medium, and the columns of ejectors are approximately perpendicular.

Ideally, each ejector when activated ejects a droplet identical in size to the droplets of all the other ejectors in the array. Thus, each ejector should operate under identical conditions.

In acoustic printing, the general practice is to address individual ejectors by applying a common RF pulse to a segment of a row, and to control the current flow to each ejector using column switches. In some cases it is desirable to use one column switch for several rows in parallel in order to reduce the number of column driver chips and wire bonds, and hence cost, in the system. Unfortunately, this approach results in parasitic current paths which can cause undesired RF current to flow through ejectors that are not in an ON state.

In existing systems, the switching ratio is limited and will vary with the number of ejectors that are ON in a given row. A switching ratio is defined as the RF power in an OFF ejector, to the RF power in an ON ejector (i.e. $P_{OFF}/P_{ON}$).

FIG. 1 illustrates an acoustic switching array with a desired current path for a selected row and selected column for an existing system. Switching matrix 10 is a 4-row 12*a*, 12*b*, 12*c*, 12*d* by 64 column 14*a*, 14*b*, 14*zz* switching matrix. Rows are connected to the matrix via switching elements 16*a*, 16*b*, 16*c*, 16*d*, and columns are also connected through switching elements 18*a*, 18*b*, 18*zz*. At the intersection of the columns and rows are transducers 20. Current paths of matrix 10 are terminated at RF ground 21. It is to be appreciated that while the matrix of FIG. 1 is a 4-row by 64-column matrix, the present invention may be used in other matrix designs.

Matrix 10 is supplied by a power source 22 which provides its output to an RF signal matching circuit 24. By proper switch sequencing, a desired current path for a selected row and selected column is obtained. For example, in FIG. 1, by closing switch 16*a* and switch 18*a*, a current path is provided from the RF matching network 24 to transducer 20*a* via row 12*a* and column 14*a*. As the remaining rows and columns are unselected, only transducer 20*a* is intended to be activated to emit a droplet.

Unfortunately, the interconnect paths used to implement a low-cost acoustic printhead include unavailable, undesirable current paths, as shown and discussed for example in connection with FIGS. 2–5. One problem with the proposed printheads is that they used switches which are known as "leaky" or "lossy" switches which add to the existence of undesirable current paths. An example of the foregoing is depicted in FIG. 2. In this figure, switches 16*a* and 18*a* are maintained in a closed position while the remaining switches are unselected, and current is provided to transducer 20*a*. However, undesired current will also flow through transducer 20*b*, which is in selected row 12*a* but unselected column 14*a*. Similarly, FIG. 3 illustrates a situation where undesired current flows through transducer 20*c*, which is in selected column 18*a* and unselected row 12*c*.

FIGS. 4 and 5 set forth similar simplified depictions of switching matrix 10.

FIG. 4 illustrates a situation where 63 columns 26 and one row 12*a* are selected, i.e. are ON, and a single column 28 and remaining three rows 12*b*-12*d* are unselected, i.e. are OFF. Under this arrangement, the inventors have calculated that there is approximately 514 $\mu$A flowing through transducer 30, which represents the transducers in selected row 12*a*, and 63 ON columns 26 of matrix 10. It was also determined by this analysis that 393 $\mu$A of current will flow in transducer 32, located in selected row 12*a* and the 64th unselected column 28 of transducers. With this information, it is found that the switching ratio between these two currents is equal to:

$$393\ \mu A/514\ \mu A=0.765=-2.32\ dB.$$

FIG. 5 depicts an alternative arrangement where one column 34, and one row 12*a* are selected, and remaining 63 columns 36 and 3 rows 12*b*–12*d* are unselected. In this situation, the selected current path for transducer 38 has a current of 504 $\mu$A, whereas an unwanted current of approximately 368 $\mu$A exists through each of the unselected transducers connected to selected column 34 and unselected rows 12*b*–12*d*. This results in a switching ratio equal to:

$$368\ \mu A/504\ \mu A=0.730=-2.73\ dB.$$

The cumulative current through switch 18*a* is approximately 1607 $\mu$A (i.e. 504 $\mu$A from the transducer in column 34, row 12*a*, and from the transducers in column 34, rows 12*b*–12*d*, at 368 $\mu$A each), and the voltage at switches 18*b*–18*zz* is 741 mv.

When using aqueous inks for acoustic ink printing, the desired ejection velocity will be approximately 4 m/sec. This can be achieved using approximately 1 dB of power over the ejection threshold. Given that there are power non-uniformities in the aqueous printhead of approximately +/−0.5 dB, and the desire to maintain some margin of safety (e.g. −0.5 dB) to insure that ejectors which are unselected are truly OFF, an appropriate switching ratio may be found by the restrictions of: switching ratio (SR)>(overdrive for 4 m/sec)+(non-uniformity)+(margin to insure appropriate OFF state), which results in:

$$SR \geq 1+0.5+0.5=-2\ dB.$$

Therefore, a switching ratio of −2.5 to −3.0 dB will be acceptable for printing of aqueous inks, when a −0.5 to −1,0 dB safety margin is added.

However, and more specifically related to the present invention, phase-change inks require more power over the threshold than aqueous inks. To achieve a necessary 4 m/sec ejection velocity, it has been determined that a −4 dB power over the threshold will be required. For phase-change inks, it is intended to use static E-fields to reduce this power requirement, however it is still necessary to eject the droplets at approximately 2 m/sec, i.e. −2 dB over threshold. Non-uniformities in the phase-change printhead are similar to those for aqueous ink printheads (i.e. +/−0.5 dB), and the margin for turning the switches fully OFF will also be similar (i.e. −0.5 dB). Therefore, the switching ratio for phase-change inks will require:

$$SR \geqq 2+0.5+0.5=-3 \text{ dB}.$$

Then, with a −0.5 to −1,0 dB safety margin added, a switching ratio of −3.5 to −4.0 dB is acceptable. Existing switching networks do not insure adequate switching ratios for phase-change printing when the foregoing requirements are taken into consideration.

It has thus been determined desirable to increase the switching ratio, and to control the switching ratio at a desired level, independent of the number of ejectors which are ON. It has also been determined desirable to provide such control in a circuit which is compact, manufacturable, and is functional with the general designs of acoustic printheads.

SUMMARY OF THE INVENTION

Two embodiments of column switch compensation circuits are disclosed which act to ensure a necessary level of turnoff for column switches in a transducer matrix. With attention to another aspect of the invention, shown are several integrated semi-conductor architectures for use in a compensation circuit which drives transducers of an acoustic printhead. The architectures disclose switching circuitry which provides for an injection of compensating current in order to improve the turn off an unselected column in a transducer switching array or matrix. The integrated circuits are designed to provide isolation between a column switch, integrated as a high-voltage diode, and a compensation switch, configured as a switching diode or PMOS switch which operates inversely to the column selecting switch. Implementation of the compensation switch ensures a desired turn-off of an unselected column switch associated with an unselected transducer.

BRIEF DESCRIPTION OF THE DRAWINGS

FIG. 4 depicts a simplified representation of FIG. 1 wherein a single row and 63 columns are selected, i.e. ON;

DETAILED DESCRIPTION OF THE PREFERRED EMBODIMENT

A general practice for controlling the emitters of an acoustic ink printer array is to address the individual ejectors by applying a common RF pulse to a segment of a row, and to control the current flow to each ejector using column switches. In existing systems, it is preferable to use one column switch for several rows in parallel in order to reduce the number of column driver chips and wire bonds, and therefore cost, in the system matrix.

Unfortunately, this approach results in parasitic current paths which can limit the effective switching ratio of the RF column switches, and can result in switching ratios that vary with the number of ejectors in an ON state in a given row. For phase change acoustic ink printing, there is a need for switching ratios in excess of the typical −2–3 dB minimum that can be achieved with ganged 4-row column switches. U.S. patent application Ser. No. 09/449,038, entitled Method and Apparatus For Achieving Controlled RF Switching Ratios To Maintain Thermal Uniformity In The Acoustic Focal Spot Of An Acoustic Ink Printhead, filed Nov. 24, 1999, and hereby incorporated by reference, describes various architectures which permit for precise control of the switching ratio, independent of the number of ejectors ON or OFF, in order to limit thermal non-uniformities in printheads. the switching ratio, independent of the number of ejectors ON or OFF, in order to limit thermal non-uniformities in printheads.

Figure 6:
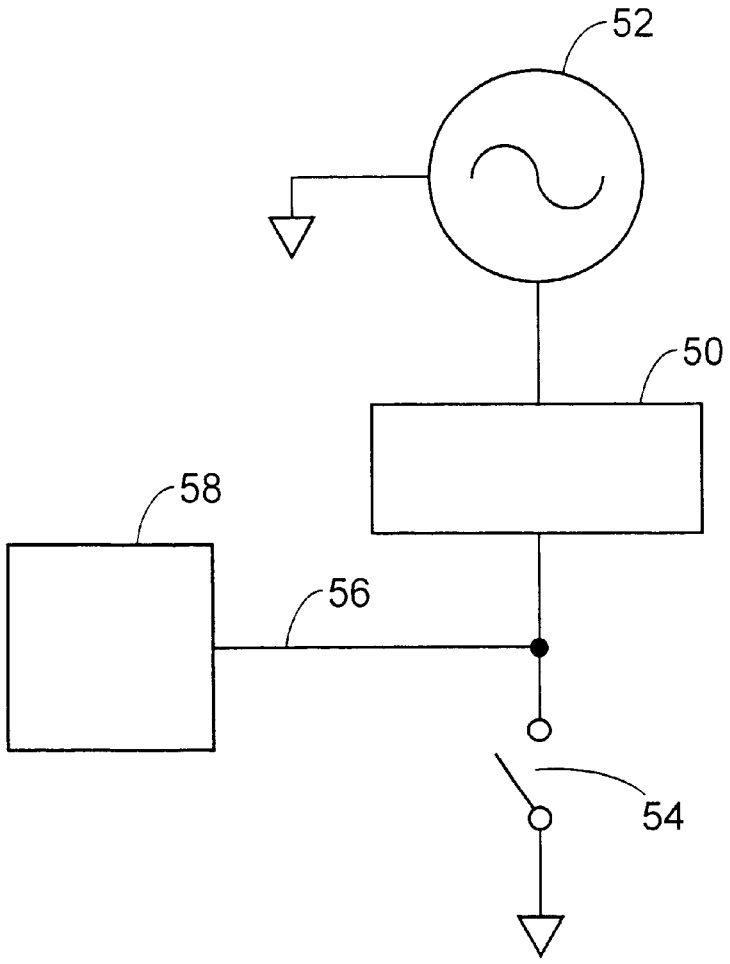
FIG. 6 shows a simplified circuit showing a compensation concept of the present invention.

The compensation network, shown in FIG. 6, illustrates the concept of providing a compensating current path to the column nodes of the transducer signal for the required level of compensation. A transducer 50, of the type in acoustic printheads, is interconnected between a power source 52 and a switch 54. It is noted that switch 54 is considered a "leaky" or "lossy" switch, and when unselected, may not be entirely OFF. The "leaky" nature of switch 54 means a current path may exist whereby undesirable current flows through transducer 50. A concept of the present invention is to inject an RF current 56 from a current source 58 which will cause the voltage at the switch to rise when the switch is in an OFF state. This improves the turn off of switch 54, thereby providing a more complete OFF state. Providing a stronger turn-off for such switches, means less undesirable current will flow, allowing for an increase in the switching ratio. A switching ratio has been defined as the ratio of the undesired RF power in an OFF ejector, to that in an ejector that is in an ON state (i.e. $P_{OFF}/P_{ON}$).

Figure 7:
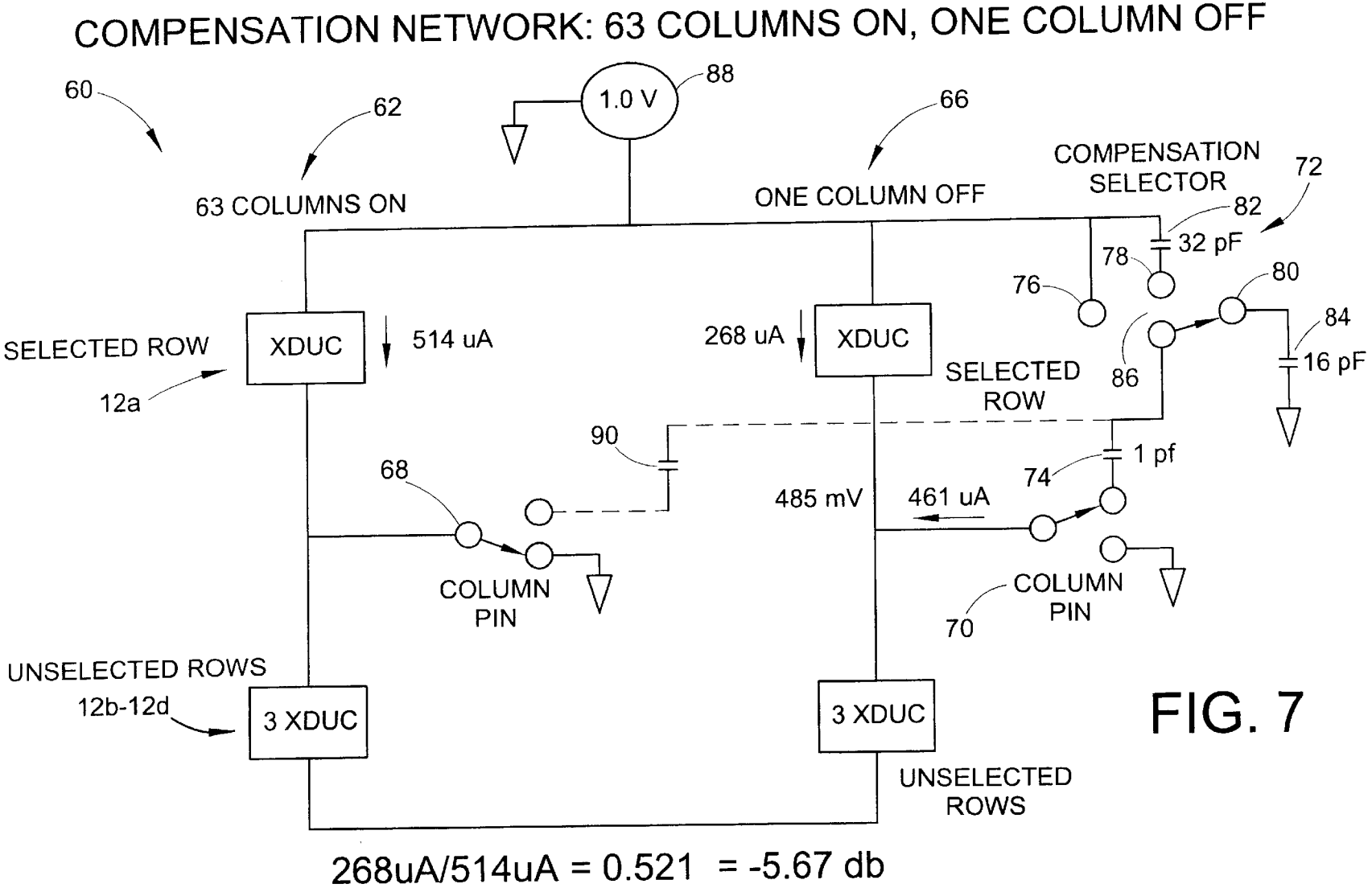
FIG. 7 is a simplified representation of the switching network of FIG. 1 including a column scheme to increase the switching ratio.

FIG. 7 shows a simplified version of switching matrix 60 having 4 rows and 64 columns. In this example, switching matrix 60 has 63 selected columns 62, and a single selected row 12*a*. This circuit also depicts a single unselected column 66 and 3 unselected rows 12*b*–12*d*. A column switch 68 is in a selected position, which corresponds to the selection of the 63 columns 62. Switch 70 is in an unselected state.

A compensation circuit 72 is provided which includes a first capacitor 74, and switching terminals 76, 78 and terminal 80. Terminal 78 has included therein a 32 pico-farad compensation capacitor 82, and terminal 80 has a 16 pico-farad compensation capacitor 84. In this initial representation, when selector 86 is at terminal 76, a connection is made from RF source 88 through capacitor 74 to switch 70. Similar to the discussion in connection with the switching network of FIG. 6, this arrangement injects a supplementing current through capacitor 74, which insures a strong turn-off of switch 70. Alternatively, terminal 78 may be selected by selector 86 whereby the compensation current is provided through a capacitive coupling to RF source 88. A further manner in which additional current can be injected to the unselected column switches is through selector 86 connecting to terminal 80, which provides for a capacitive coupling to ground for switch 70.

By injecting different levels of current into the column switches in this manner, it is possible to increase and stabilize the effective switching ratio for a number of ejectors irrespective of those which are ON or OFF. FIG. 7 illustrates a case where 63 ejectors are ON and one OFF, in which the switching ratio relative to the selected row/unselected column has been increased. Specifically, transducers in the selected columns have 514 $\mu$A and the transducers in the unselected column has 268 $\mu$A. Therefore, the switching ratio is:

268 micro-amps/514 micro-amps=0.521=−5.67 dB.

It is worth noting that switching capacitor 90 is provided for connection to columns 1–63. It is to be appreciated that capacitor 90 represents a network of compensation capacitors such that each column has appropriate capacitive valves.

Figure 8:
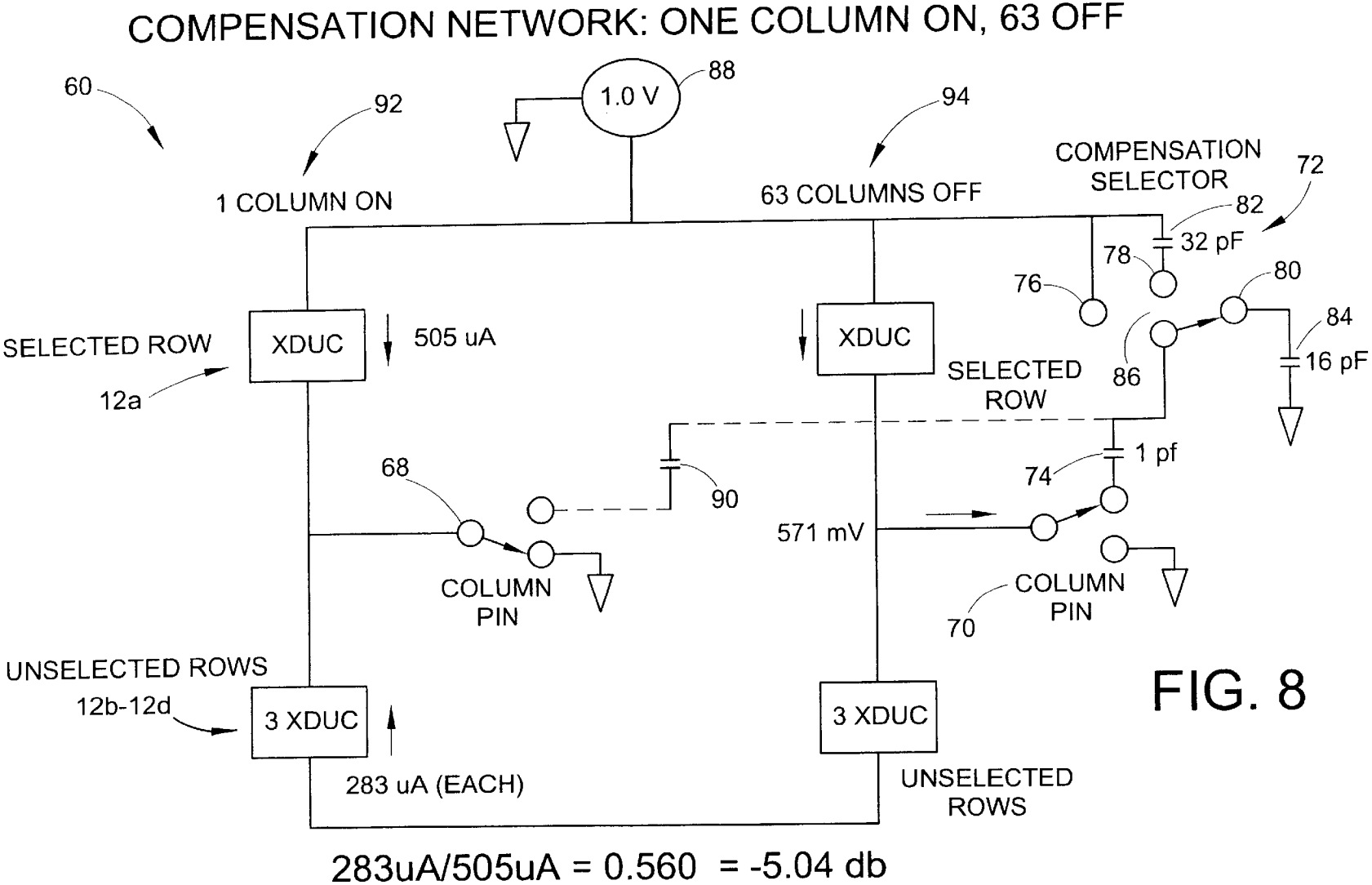
FIG. 8 depicts a case where 63 ejectors re in an OFF state and a single ejector is in an ON state.

To emphasize the foregoing concept, illustrated in FIG. 8 is matrix configuration 60 of FIG. 7, where a single column is selected 92 and 63 columns are unselected 94. Further, a single row is selected 12*a* and three rows of the matrix are unselected 12*b*–12*d*. Compensation selection network 72 is shown with selector 86 connected to terminal 80, which includes compensation capacitor 84 coupled to ground. In this example, the switching ratio is:

283 micro-amps/505 micro-amps=0.560=−5.04 db.

Figure 1:
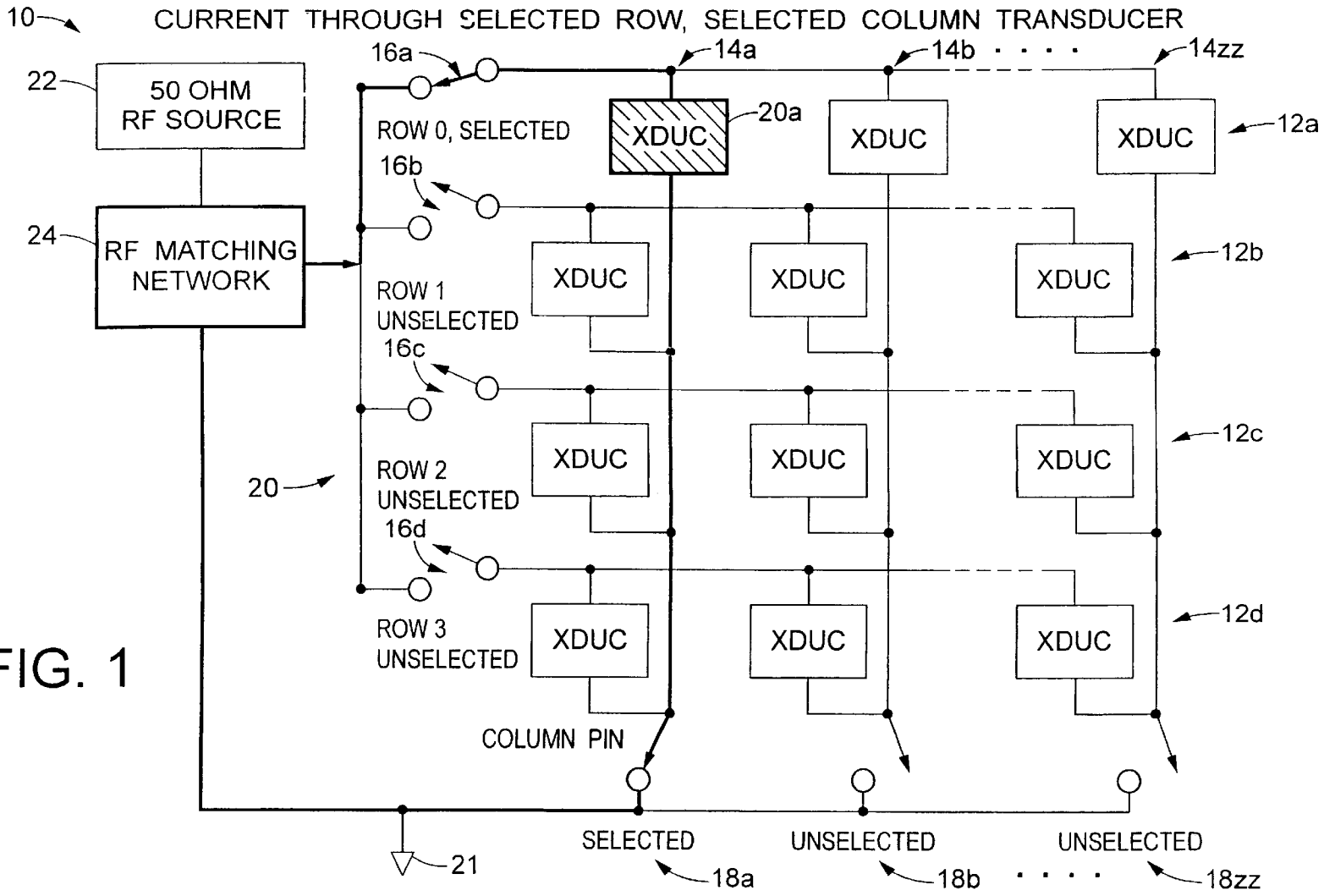
FIG. 1 illustrates a switching matrix for an acoustic printhead.
Figure 2:
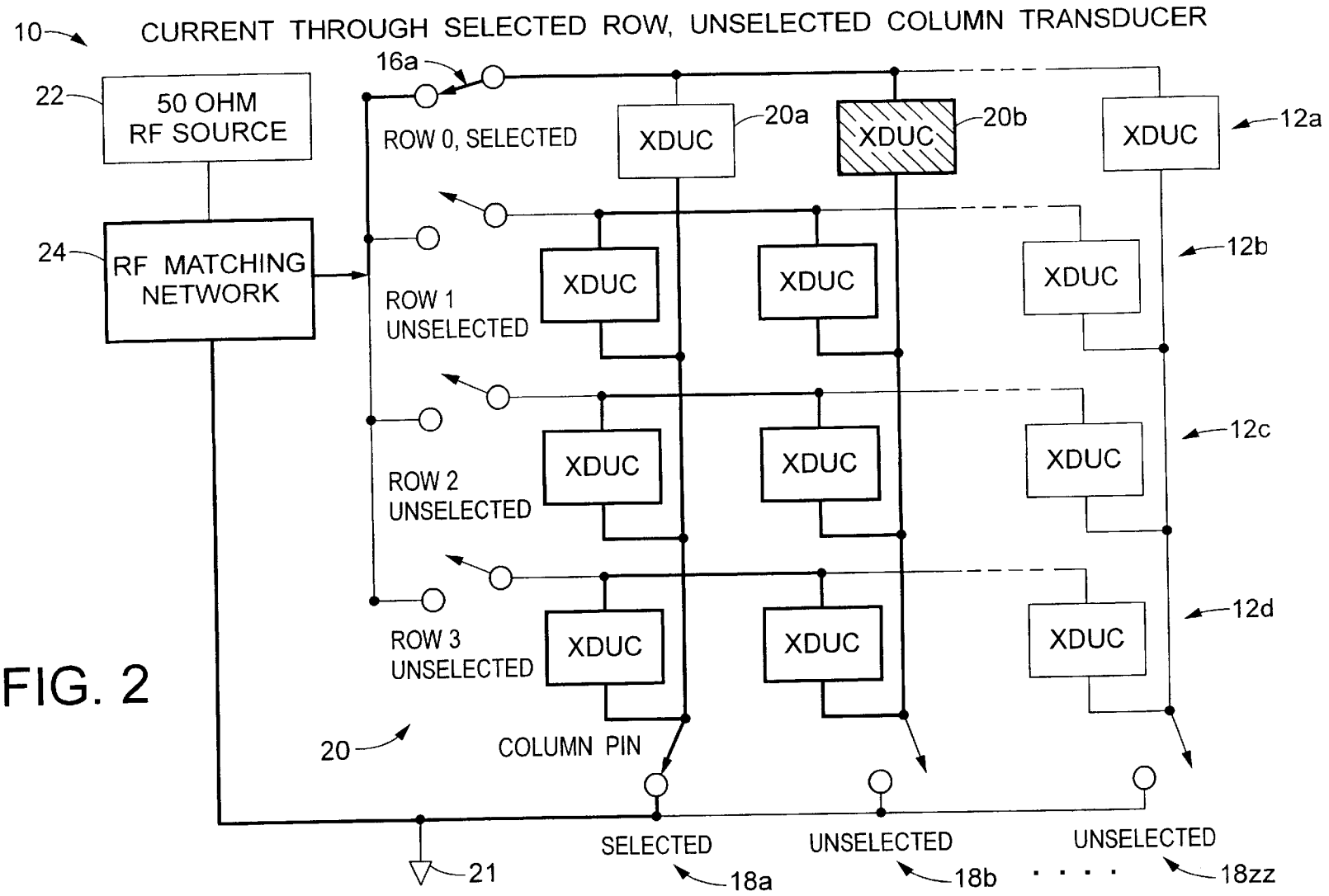
FIG. 2 depicts the matrix of FIG. 1 showing a concept of current leakage in a selected row, unselected column situation.
Figure 3:
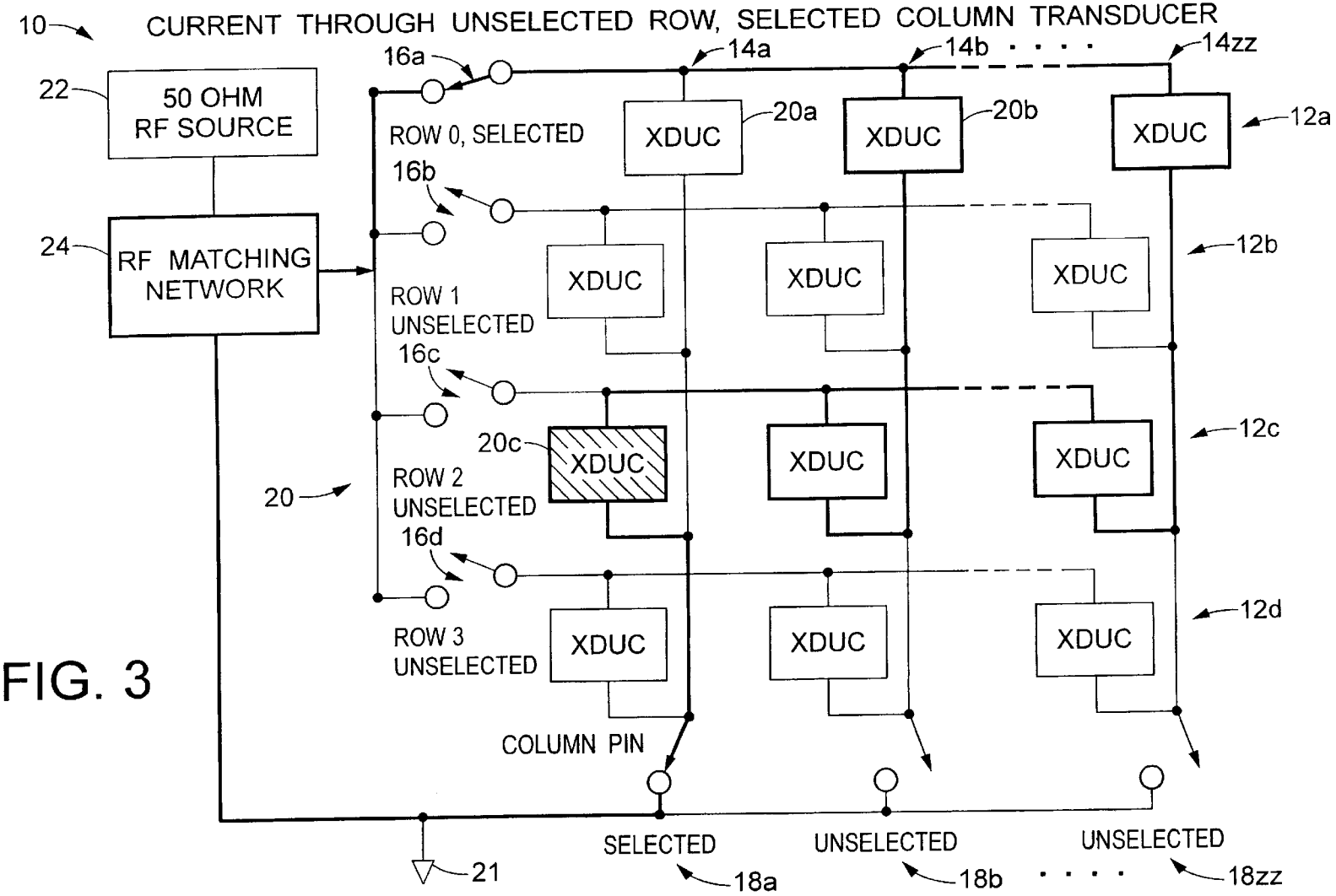
FIG. 3 shows the matrix of FIG. 1 in an unselected row, selected column situation.
Figure 4:
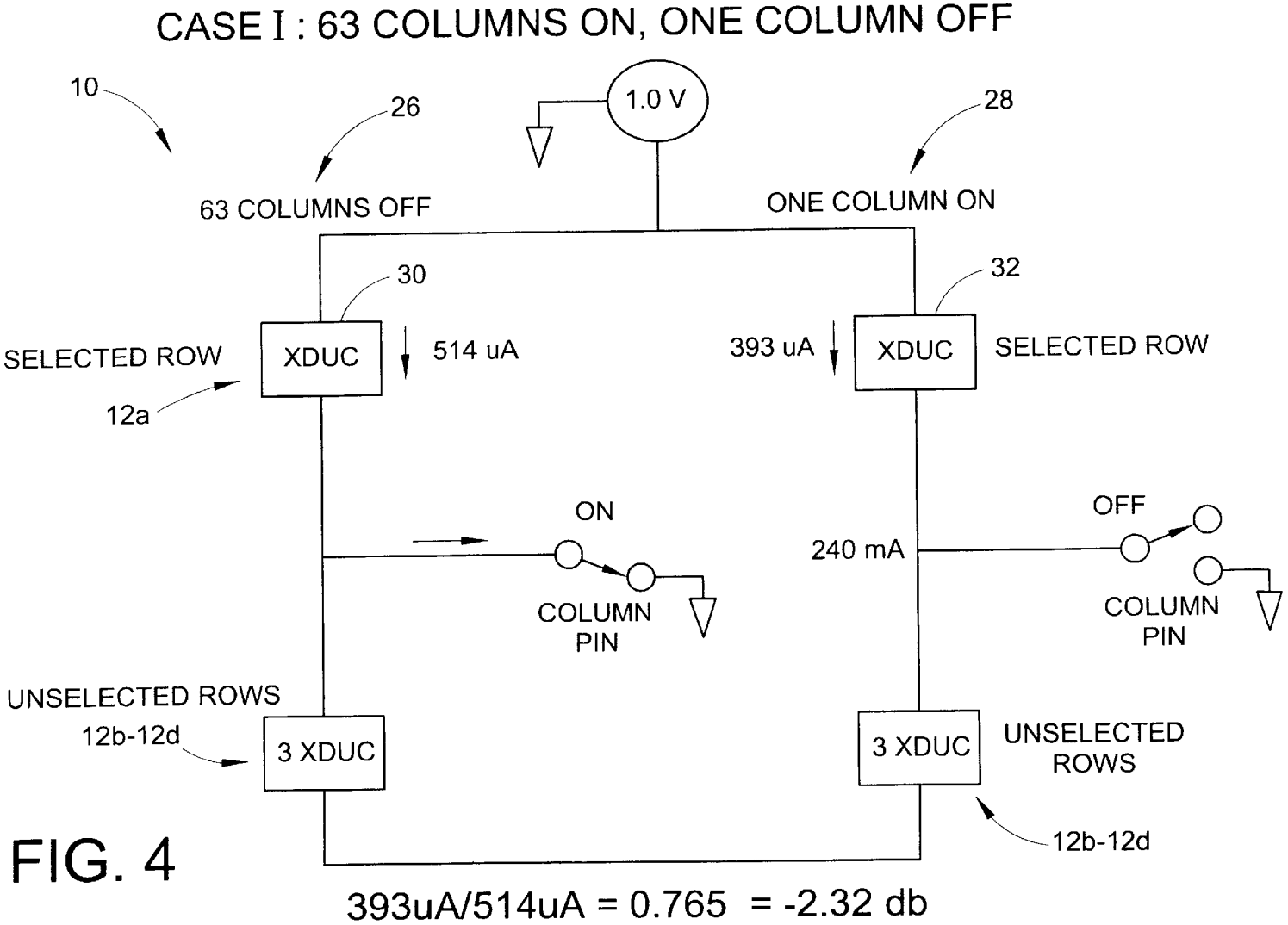
Figure 5:
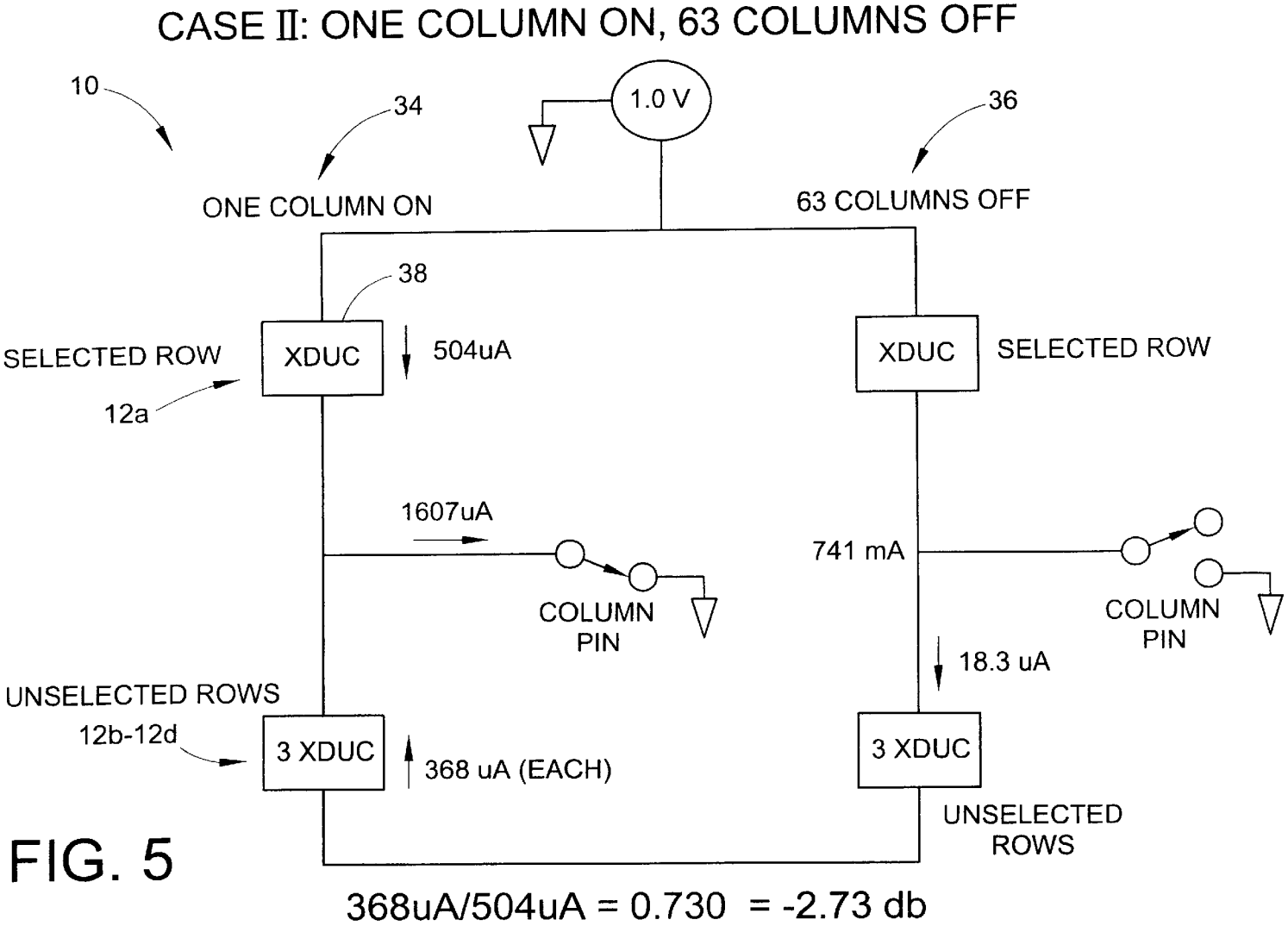
FIG. 5 sets forth the simplified representation of FIG. 1 wherein a single row and single column are selected.

Thus, whereas the switching network 10 of FIG. 4 (which includes 63 selected columns and one selected row) has a switching ratio of −2.32 dB, the addition and use of compensation selection network 72 of FIG. 7 is able to increase this switching ratio to −5.67 dB. Similarly, whereas the switching network of FIG. 5 (which includes one selected column and one selected row) has a switching ratio of −2.73 dB, FIG. 8 which also has a single selected column and a single selected row, uses the compensation selection network 72 to increase its switching ratio to −5.04 dB. Thus, the foregoing discussion illustrates the addition of a compensation selection network 72 allows for an improvement in the switching ratio for ejectors of an acoustic ink printer.

Turning attention more particularly to the present invention, described are various architectures which may be employed to manufacture a switching design used to provide compensation current so as to lower undesirable current in an OFF transducer of an acoustic ink printhead.

In a switching network of the present invention, a voltage source generates a signal which is routed through a selected transducer by applying the signal to the selected row of the array and grounding the selected column of the array. The row is selected by forward biasing a row switch, which in one embodiment may be a diode, such as a PIN diode, and the column is selected by turning on a column switch, which in the present embodiment is a diode, such as a high voltage (HV) diode. However, other paths exist through the array from the voltage source (VRF) to the selected column, which are in parallel with the primary selected path. The impedance of the effective secondary paths will vary with the number of columns selected at any one time. This means in circuits without the compensation network of the present invention, the effective ON vs. OFF current through a selected transducer, and therefore the switching ratio, will vary considerably, depending on the number of columns being selected.

Figure 9:
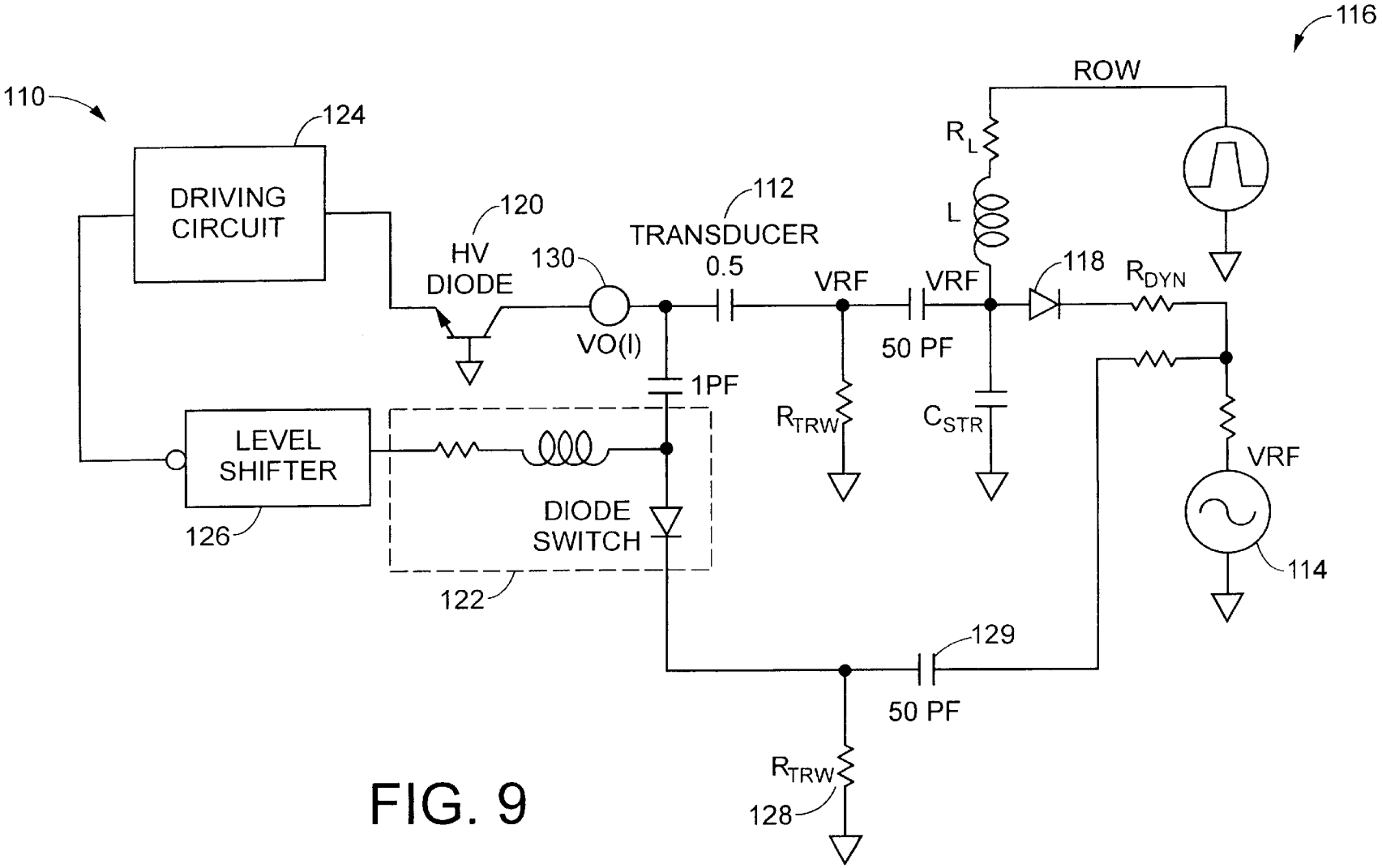
FIG. 9 is a first embodiment of driving circuitry to accomplish the concepts of the present invention.
Figure 10:
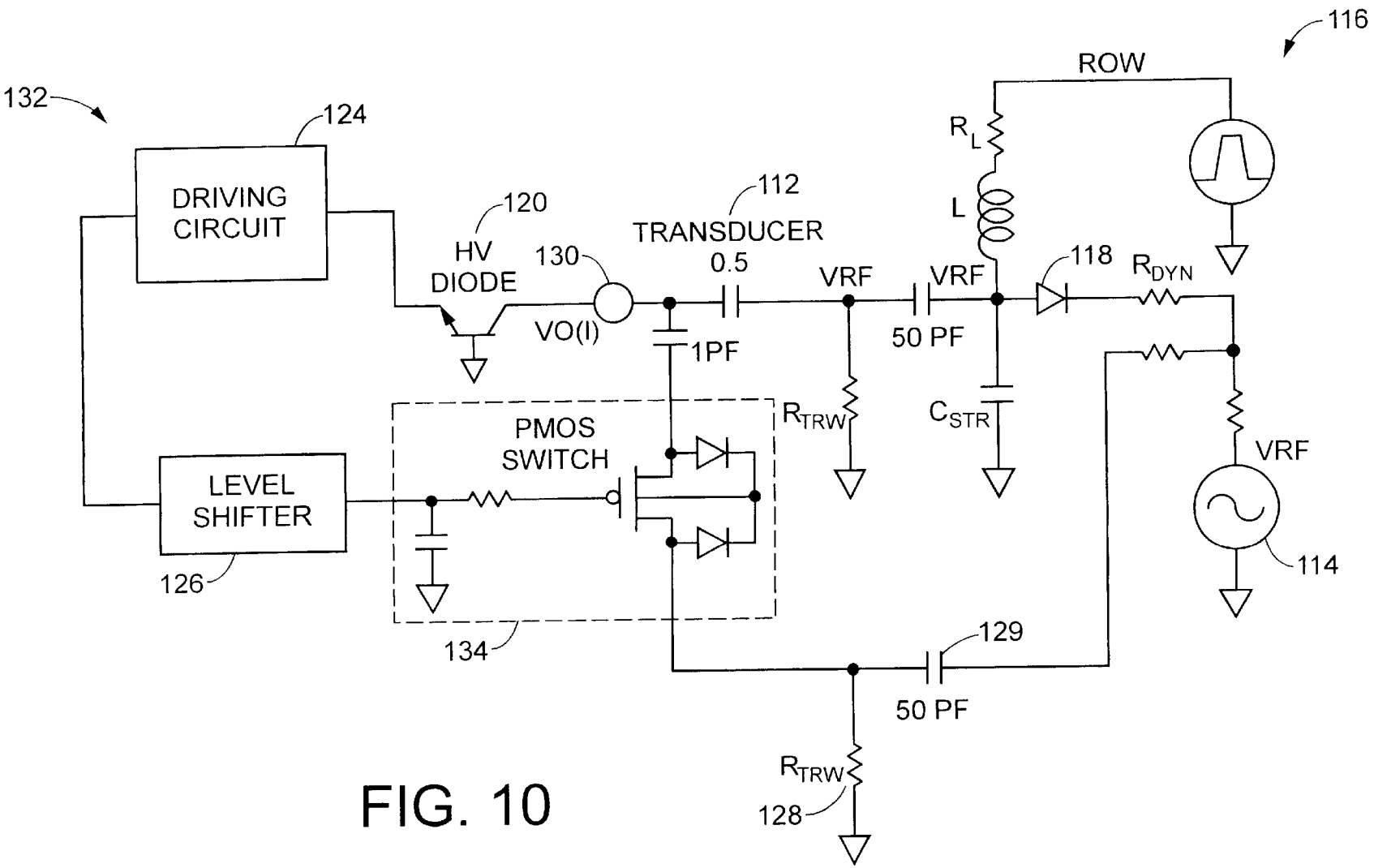
FIG. 10 is a second embodiment of driving circuitry to accomplish the concepts of the present invention.

Turning to FIGS. 9 and 10, illustrated are two embodiments of compensation circuits 110, 132, which realize the functions that provide the desired ON to OFF switching ratio across a printhead array over selected and unselected rows and columns. Compensation circuits 110, 132 are for incorporation in the overall transducer switching matrix previously described, and are designed to provide column compensation.

Capacitor 112, modeled as a 0.5 pf capacitor, represents a selected transducer of the switching matrix. In compensation circuit 110 a signal from voltage reference source 114 is routed through selected transducer 112 by applying the signal to the selected row, by row selection mechanism 116 of the matrix, and grounding the selected column of the matrix. The row is selected by selection mechanism 116, by forward biasing PIN diode 118. The column is selected by turning on HV diode 120. As previously discussed, there are alternative paths through the matrix from voltage reference source 114 to the selected column, which are in parallel with the primary selected path. Without current compensation, impedance of the effective secondary path would vary with the number of columns selected at any one time, and the effective ON vs. OFF current through a selected transducer would vary considerably depending on the number of columns selected.

Compensation circuit 110 obtains a desired switching ratio by applying compensating currents to the columns or rows of a switching matrix which are not selected. Compensating current is obtained by use of an extra RF compensation switch 122 for every column switching diode 120, where the compensation switch 122 is designed to switch in an inverse fashion of column switching diode 120. In FIG. 9, the compensation switch 122 is a diode switch configuration. When column switching diode 120 is ON, and a column is selected, diode switch configuration 122 is OFF. Driving circuit 124 drives column switching diode 120 upon selection of the associated column. Alternatively, when a particular column is in an unselected state, column switching diode 120 will be OFF and diode switch 122 will be ON.

When in a non-selected state, input from driving circuit 124 is provided to level shifter 126, and the output of level shifter 126 acts to turn on the diode switch configuration (extra RF switch) 122. Injection of compensation current pulls this portion of the compensation circuit to a stronger OFF state, as it is brought to voltage ground through terminating resistor 128. To hold compensation switch 122 OFF, the voltage at terminating resistor 128 will be larger than the voltage at the cathode of diode switch 122. To turn compensation switch 122 ON, the voltage at terminating resistor 128 will be lower than that at compensation switch 122. Compensation switch 122 is designed to be electrically isolated from the operational characteristics of the column switching diode 120. The inclusion of bonding pad 130 shows that column switching diode 120 may be located on a separate chip from transducer 112, although they may also be provided on an integrated device.

Turning to FIG. 10, a distinction between compensation circuit 132 of FIG. 10, and compensation circuit 110 of FIG. 9 is the use of a PMOS switch configuration 134, as the extra RF switch to ensure proper compensation in turning OFF unselected columns. The operational concepts of compensation circuit 132 are substantively the same as compensation circuit 110. Therefore PMOS switch 134 also operates in an inverse manner to column switching diode 120, in order to reduce non-switch current through transducer 112.

In FIGS. 9 and 10, the equivalent transducer circuit is modeled with 0.5 pF in series with 300 ohms. An RF switch is modeled in an ON state with 50 ohms, and in a OFF state as a 0.25 pF capacitor which translates to 4 k ohms at the selected operational frequency. Compensation circuits 110, 132 are designed in one embodiment such that a switching ratio of 5 dB or better exists across the printhead array.

Figure 11:
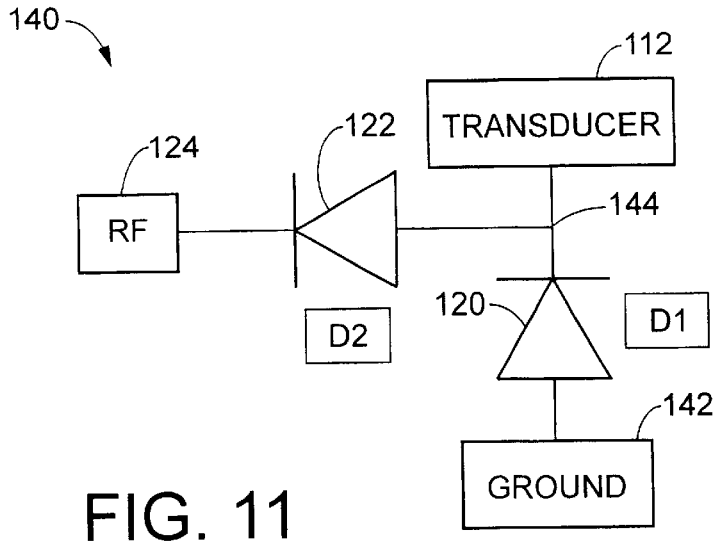
FIG. 11 is a simplified illustration of the relationship between a switching diode and an RF compensation diode according to the teachings of the present invention.

FIG. 11 is a simplified compensation circuit 140 depicting operation between column switching diode 120, and compensation diode 122. When transducer 112 is selected by a selecting device (not shown) column switching diode 120, acting as a switch, turns on providing a circuit path for transducer 112 to ground 142. Alternatively, when transducer 112 is in a non-selected state, in order to ensure sufficient turn-off of diode switch 120, a signal is applied by RF or driving circuit 124, whereby switch 122 is turned on and a sufficiently high voltage is provided at junction 144 placing column switching diode 120 at a strong off state. Further FIG. 11 may be modified by removing compensation switch/diode 122, and replacing it with an element such as PMOS switch 134 of FIG. 10.

A circuit including PMOS switch 134 would function in a substantially similar manner as the circuit with compensation switch/diode 122.

Figure 12:
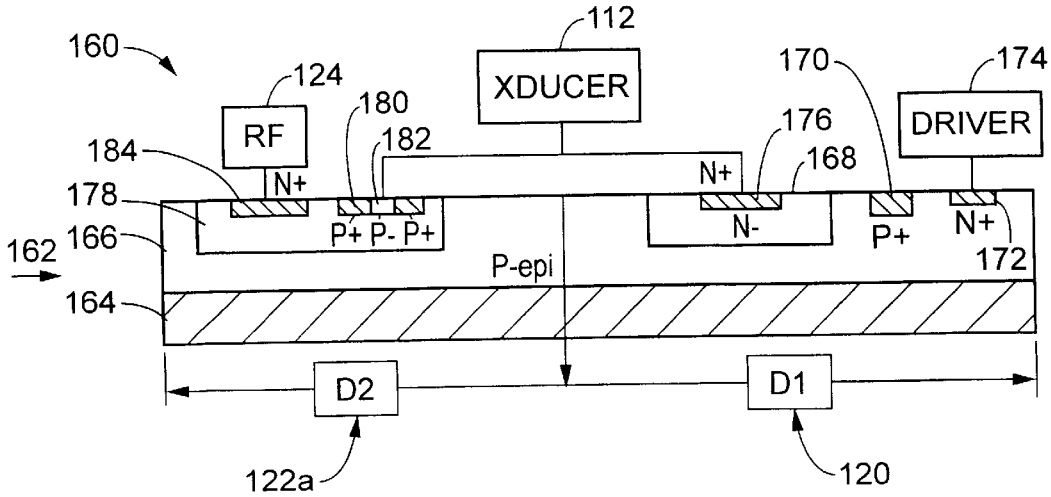
FIG. 12 depicts a first embodiment of a compensation circuit configured as an integrated semi-conductor circuit.

FIG. 12 illustrates an integrated compensation circuit 160, having the operational characteristics described in connection with the circuit of FIG. 9, and as described in the simplified illustration of FIG. 11. Integrated circuit 160 and the following circuits which are to be described, may be produced in accordance with known processes of manufacturing integrated circuits, including wafer production, wafer fabrication, thermal oxidation or deposition, masking, etching, doping, dielectric deposition and metalization, passivation, and testing.

Integrated circuit 160, includes a base 162 of a P-Type substrate 164 and a P-epi material 166. Column switching diode 120 is created by forming within the P-epi material 166, a negative N minus well 168, a P plus diffusion 170, a N plus diffusion contact or pad 172 for connection to a driver circuit 174, and a N plus diffusion contact or pad 176, formed within the N minus well 168, for connection of switching diode 120 to transducer 112.

A compensation diode 122*a*, which functions as compensation diode 122 of FIG. 9 is configured at another location of base 162. Compensation diode 122*a* is electrically isolated from column diode 120, ensuring an improved off switching for column diode 120 during an unselected time period.

Compensation diode 122*a*, is configured with a N minus well 178 formed in P-epi material 166. Within N minus well 178, a P minus diffusion 180 and a transducer P plus diffusion contact or pad 182 are formed. P plus diffusion pad 182 connects P minus diffusion 180 to transducer 112. Integrated semiconductor circuit 160 is further provided with a N plus diffusion contact or pad 184, connecting the N minus well 178 to signal 124.

Through the above configuration, integrated circuit 160 will turn column diode 120 ON and OFF depending on selection signals provided by, for example, a controller. A selection signal turns compensation diode 124 ON when the column in which transducer 112 is located is in an unselected state. The described formation of column diode 120, and compensation diode 122*a* results in compensation diode 122*a* having a floating ground with respect to column diode 120. Compensation diode 122*a* may be considered a floating diode since its ground is not tied to the ground of column diode 120. Compensation diode 122*a*, may be built using P-Base, P-Well or P-Field in an N-well. In constructing integrated circuit 160, consideration will need to be paid to the breakdown voltage of the P-Base and P-Field, N-Well biasing relative to the substrate, as well as parasitics and PNP action to the substrate.

Figure 13:
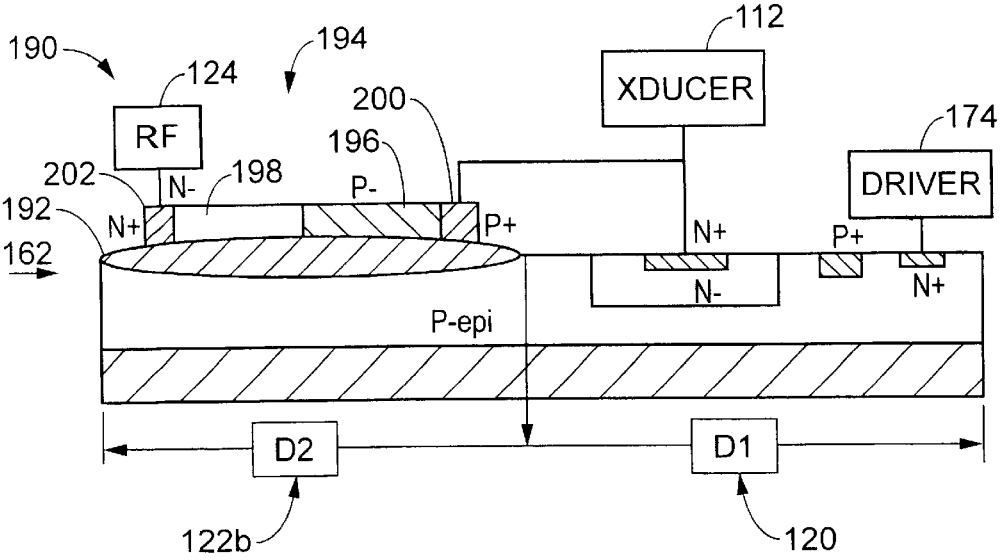
FIG. 13 depicts a second embodiment of the compensation circuit.

FIG. 13 shows an integrated compensation circuit 190 according to the teachings of a second embodiment. Column switch diode 120 is formed on base 162 in the same manner as described in connection with FIG. 12. However, in this embodiment, a compensation diode 122*b* is built into a resistive material, such as a thin poly-film 192, whereby compensation diode 122*b* is isolated from base 162. On top of thin field oxide film 192 is formed high-voltage diode junction material 194, where a P minus doped poly 196 is diffused adjacent a N minus doped poly 198 to form a PN junction. A P plus doped poly contact or pad 200 is used as a connection contact to transducer 112, and a N plus material is used as a connection contact or pad 202 to RF source 124. Again, since compensation diode 122*b* is not connected to the same ground as column diode 120, these two elements are electronically isolated from each other. In construction of compensation diode 122*b*, consideration will need to be given to its breakdown voltage, its speed, as well as biasing requirements.

Figure 14:
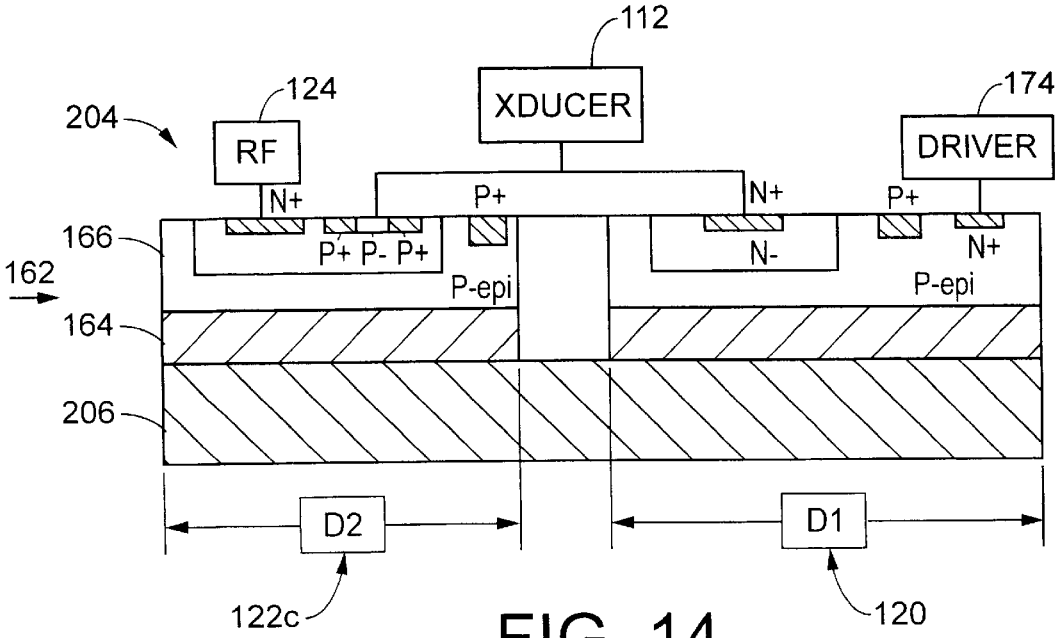
FIG. 14 illustrates a third embodiment of the compensation circuit.

With attention to FIG. 14, shown is a third embodiment of an integrated compensation circuit 204 including column diode 120 and compensation diode 122*c*. In this third embodiment, the design of column diode 120 and compensation diode 122*c* are the same as described in connection with FIG. 12. However, in this embodiment, the diodes are formed on separate substrates or are formed on the same substrate and the substrate is cut. This physical separation can provide a higher degree of isolation, than which is obtained by manufacturing the diodes on the same substrate. The diodes are then bonded together on a second substrate 206. The bonding of the diodes to the second substrate 206 provides a uniform platform for integration of compensation circuit 204 into an acoustic printhead. It is to be noted that second substrate 206 may be comprised of a variety of materials, including a silicon bonding wafer, with oxide, or any number of insulative materials which will ensure isolation between column diode 120 and compensation diode 122*c*.

Figure 15:
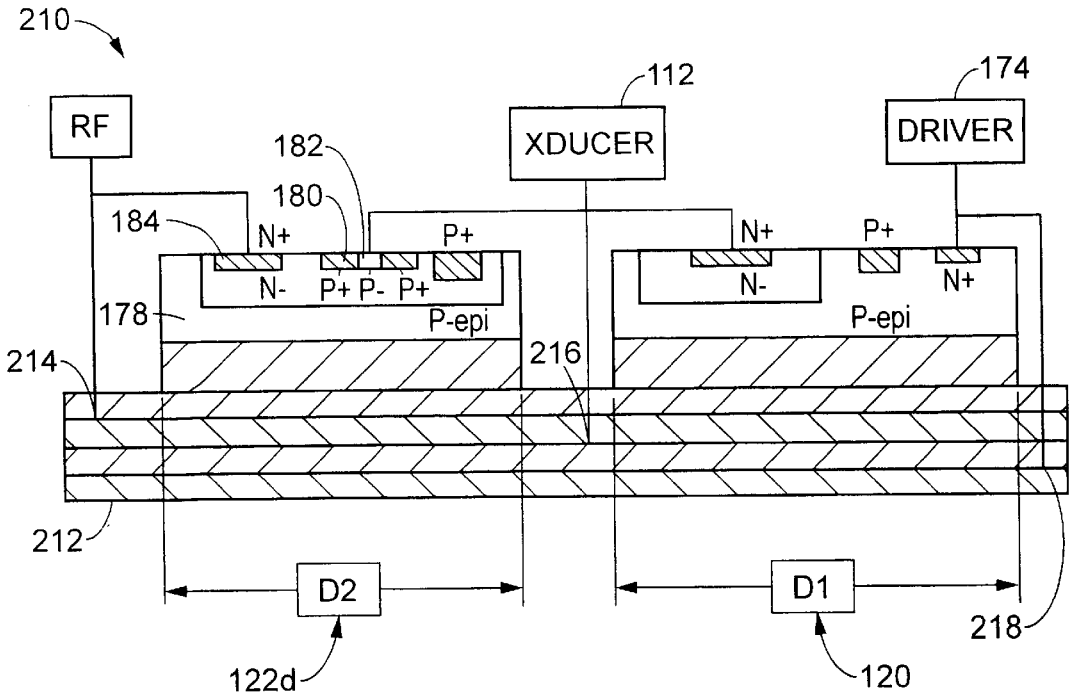
FIG. 15 depicts a fourth embodiment of the compensation circuit.

FIG. 15, shows an integrated compensation circuit 210, wherein column diode 120 and compensation diode 122*d* are formed in a manner similar to FIG. 14, as they are either formed on separate substrate or are formed on the same substrate and then physically separated. The separated diodes are then mounted on a second substrate. In this embodiment the second substrate is a flex material 212. The interconnections of RF source 124, transducer 112, and driver 174 are made from circuit 210, via layers 214, 216, and 218, respectively, of flex material 212.

In the preceding embodiments compensation diodes 122*a–d* are designed as a diode in a diode, whereby reverse biasing of the N-substrate of compensation diodes 122*a–d* act to isolate compensation diodes 122*a–d* from column diode 120, while at the same time the inner diode may be used for compensation.

Returning attention to FIG. 10, illustrated is a diagram for a driving circuit employing a column diode 120 and a PMOS device 134, such as a transistor. The integrated semiconductor circuit 220 of FIG. 16 performs the functions of the circuit described in connection with FIG. 10.

Figure 16:
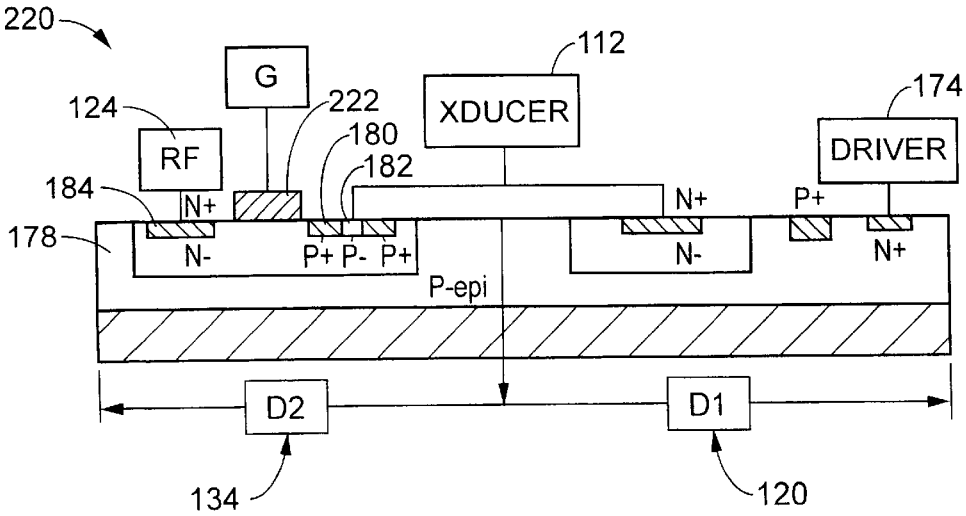
FIG. 16 depicts a fifth embodiment of the compensation circuit.

FIG. 16 is substantially identical to the design of integrated circuit 160 of FIG. 12. However, in addition to the steps which formed compensation diode 122*a* of FIG. 12, added is gate 222 deposited on top of N-material 178. Addition of gate 222, along with P-material 180, connection pad 182 and RF connection pad 184 form PMOS switch 134.

It is to be appreciated that PMOS switch 136 of FIG. 16 may be implemented in place of the diodes 122*a–d* of the previously discussed embodiments.

Additionally, as shown more particularly in FIGS. 9 and 10, the design of the compensation switch is accomplished by including capacitors which the compensation switches 122*a–d* or PMOS switch 134 will follow.

The present description sets forth various embodiments of forming a high voltage column switching diode and an RF compensation switch. The disclosed designs act to provide current compensation in order to ensure that when a column or row of transducers are not selected in a switching matrix of an acoustic printhead, the unselected transducers are in a strong OFF state.

It is to be noted that the preceding discussion discussed the use of acoustic ink printers for the expulsion of ink droplets. It is, however, to be understood that the concepts of acoustic ink printing may be implemented in other environments other than two-dimensional image reproduction. These include the generation of three-dimensional images by droplet application, the provision of soldering, transmission of medicines, and other fluids.

The foregoing is considered as illustrative only of the principles of the invention. Further, since numerous modifications and changes will readily occur to those skilled in the art, it is not desired to limit the invention to the exact construction and operation shown and described and accordingly, all suitable modifications and equivalence may be resorted to falling within the scope of the invention.

Having thus described the invention, it is now claimed:

1. In an acoustic printhead having a matrix of drop ejectors arranged in rows and columns, a compensation circuit is provided for driving at least one drop ejector of the matrix of drop ejectors, the compensation circuit comprising:

a transducer associated with the at least one drop ejector;

a column switch connected to the transducer, the column switch being closed to move the transducer to an on state, and the column switch being opened to move the transducer to an off state;

a driver circuit connected to the column switch to selectively provide energy to the column switch, wherein when energy is provided to the column switch, the column switch is closed and the transducer is energized and moved to the on state, and when the driver circuit removes energy from the column switch the transducer is moved to the off state;

a compensation switch connected to the column switch, to provide additional turn off energy to the column switch; and a signal source connected to the compensation switch to selectively turn on the compensation switch to thereby deliver the additional turn off energy to the column switch, wherein the column switch and the compensation switch are designed to function in a manner inverse to each other.

2. The invention according to claim 1 wherein the column switch and the compensation switch are electrically isolated from each other.

3. The invention according to claim 1 wherein the column switch is a high voltage switching diode, and the compensation switch is a compensation diode.

4. The invention according to claim 1 wherein the column switch and the compensation switch are configured as an integrated circuit.

5. The invention according to claim 4 wherein the column switch and the compensation switch are formed on a single substrate of a P type material, the column switch configured with a separate N minus well, and a separate P plus material well within the P type material, a driver connection pad, and a transducer connection pad, wherein the column switch is formed as a column switching diode; and the compensation switch configured with a N minus well in the P type material, a P plus material well within the N minus well, a transducer connection contact, and a current source connection contact, wherein the compensation switch is formed as a compensation diode.

6. The invention according to claim 5 further including forming a gate on the N minus material of the compensation switch, whereby the compensation switch is a three terminal device.

7. The invention according to claim 6 wherein the three terminal device is a PMOS transistor.

8. The invention according to claim 4 wherein the column switch and the compensation switch are formed on a single substrate of a P type material, the column switch configured with a separate N minus well and a separate P plus material well within the P type material, a driver connection contact, and a transducer connection contact, wherein the column switch is formed as a column switching diode; and the compensation switch being built into a resistive thin poly-film deposited on top of the field oxide, a P minus material diffused into the thin poly-film, an N minus material diffused into the thin poly-film, adjacent the P minus, thereby forming a PN junction, a P plus material diffused into the thin poly film as a transducer connection contact, and a N plus material diffused onto the thin poly film used as a transducer connection contact.

9. The invention according to claim 8 further including depositing a gate on the N minus material of the compensation switch, whereby the compensation switch is a three terminal device.

10. The invention according to claim 9 wherein the three terminal device is a PMOS transistor.

11. The invention according to claim 4 wherein the column switch, and the compensation switch are on separate first substrates of a P type material, the column switch being formed by creation of a separate N minus well and a separate P plus material well within the P type material, the column switch formed as an integrated chip further including a driver connection contact and a transducer connection contact; and the compensation switch being formed by creation of a N minus well in the P type material, a P plus material well within the N minus well, the compensation switch formed in the integrated circuit further including a transducer connection contact and a current source connection contact; and a second substrate layer, on which the column switch and the compensation switch are bonded, whereby the second substrate layer provides isolation between the column switch and the compensation switch.

12. The invention according to claim 11 further including depositing a gate on the N minus material of the compensation switch, whereby the compensation switch is a three terminal device.

13. The invention according to claim 12 wherein the three terminal device is a PMOS transistor.

14. The invention according to claim 4 wherein the column switch, and the compensation switch are formed on separate first substrates of a P type material, the column switch being formed by creation of a separate N minus well and a separate P plus material well within the P type material, the column switch formed as an integrated chip further including a driver connection contact and a transducer connection contact;

the compensation switch being formed by creation of a N minus well in the N plus material, P plus -material well within the N minus well, the compensation switch formed in the integrated circuit further including a transducer connection contact and a current source connection contact; and a flex substrate, wherein the separate column switch is in a mounted relationship at a first relationship on the flex substrate, and the separate compensation switch is in a mounted relationship at a second location on the flex substrate.

15. The invention according to claim 14 further including depositing a gate on the N minus material of the compensation switch, whereby the compensation switch is a three terminal device.

16. The invention according to claim 15 wherein the three terminal device is a PMOS transistor.

17. An acoustic printhead comprising:

a matrix of drop ejectors configured in rows and columns, each drop ejector including at least a transducer and a switch, wherein when a particular drop ejector is selected, the associated transducer and switch are turned on, and the transducer functions so as to cause the particular drop ejector to eject a drop from a pool of liquid, and when the particular drop ejector is not selected the associated transducer and switch are off, and the particular drop ejector does not eject a drop from the pool of liquid;

a plurality of row switches, connected to control operation of the rows of drop ejectors;

a plurality of column switches, connected to control operation of the columns of drop ejectors, wherein by selection of an appropriate row switch and column switch, the particular transducer of a specific drop ejector is turned on;

a controller connected to the plurality of row switches and the plurality of column switches, to control selection of the drop ejectors; and a compensation network connected to at least one of the rows of drop ejectors and columns of drop ejectors, wherein the compensation network selectively provides compensation energy to drop ejectors which are not selected, to ensure a turn off of an unselected switch of an unselected drop ejector, the compensation circuit including, a transducer associated with the at least one drop ejector, a column switch connected to the transducer, the column switch being closed to move the transducer to an on state, and the column switch being opened to move the transducer to an off state, a driver circuit connected to the column switch to selectively provide energy to the column switch, wherein when energy is provided to the column switch, the column switch is closed and the transducer is energized and moved to the on state, and when the driver circuit removes energy from the column switch the transducer is moved to the off state, a compensation switch connected to the column switch, to provide additional turn off energy to the column switch, and a signal source connected to the compensation switch to selectively turn on the compensation switch to thereby deliver the additional turn off energy to the column switch, wherein the column switch and the compensation switch are designed to function in a manner inverse to each other.

18. The invention according to claim 17 wherein the compensation network is configured to control a switching ratio of the matrix of drop ejectors, the switching ratio defined as the amount of power in a drop ejector which is off compared to the amount of power in a drop ejector which is on.

19. The invention according to claim 17 wherein the column switch and the compensation switch are electrically isolated from each other.

20. The invention according to claim 17 wherein the column switch is a high voltage switching diode, and the compensation switch is a compensation diode.

* * * * *